US010149059B2

(12) United States Patent
Maeda

(10) Patent No.: US 10,149,059 B2
(45) Date of Patent: Dec. 4, 2018

(54) SPEAKER DEVICE AND MICROPHONE DEVICE

(71) Applicant: ALPINE ELECTRONICS, INC., Tokyo (JP)

(72) Inventor: Yoshikazu Maeda, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 15/626,871

(22) Filed: Jun. 19, 2017

(65) Prior Publication Data

US 2018/0077496 A1 Mar. 15, 2018

(30) Foreign Application Priority Data

Sep. 12, 2016 (JP) ..... 2016-177712

(51) Int. Cl.

*H04R 9/04* (2006.01)
*H04R 9/02* (2006.01)
*H04R 9/06* (2006.01)
*H04R 9/08* (2006.01)

(52) U.S. Cl.

CPC ..... *H04R 9/048* (2013.01); *H04R 9/025* (2013.01); *H04R 9/06* (2013.01); *H04R 9/08* (2013.01)

(58) Field of Classification Search

CPC ..... G01R 15/202; H04R 9/048
USPC ..... 381/96, 399, 400, 408, 412, 427, 431, 381/163, 176, 398
See application file for complete search history.

(56) References Cited

U.S. PATENT DOCUMENTS 3,636,278 A * 1/1972 Heil ..... H04R 7/14 381/163
4,413,160 A * 11/1983 Ohyaba ..... H04R 9/048 381/348
4,471,172 A * 9/1984 Winey ..... H04R 9/047 381/412
4,837,838 A * 6/1989 Thigpen ..... H04R 9/047 181/172
5,009,281 A * 4/1991 Yokoyama ..... H04R 1/2811 181/153
5,748,758 A * 5/1998 Menasco, Jr. ..... H04R 23/00 381/173
6,104,825 A * 8/2000 Thigpen ..... H04R 7/00 381/408
6,111,970 A * 8/2000 Voishvillo ..... H04R 9/048 381/398
6,934,402 B2 * 8/2005 Croft, III ..... H04R 7/22 381/191

(Continued)

FOREIGN PATENT DOCUMENTS

JP 55-025231 A 2/1980

*Primary Examiner* — Gerald Gauthier
(74) *Attorney, Agent, or Firm* — Brinks Gilson & Lione

(57) ABSTRACT

A speaker device according to an embodiment of the present disclosure includes a magnetic circuit having a magnetic gap, a ribbon-like diaphragm disposed in a magnetic field in the magnetic gap, a plurality of parallel conductors provided on the diaphragm and extending in a direction orthogonal to a direction of the magnetic field, and a driving unit that supplies driving currents in the same direction to the plurality of parallel conductors. Both end portions of the diaphragm are continuous via a pivoting board disposed so as to bypass the magnetic gap, and connection conductors for spirally connecting the plurality of parallel conductors are provided on the pivoting board.

11 Claims, 6 Drawing Sheets

(56) References Cited

U.S. PATENT DOCUMENTS

| | | | | |
|---|---|---|---|---|
| 2002/0191808 | A1* | 12/2002 | Croft, III | H04R 9/047<br>381/431 |
| 2006/0056651 | A1* | 3/2006 | Yao | H04R 9/048<br>381/399 |
| 2007/0286447 | A1* | 12/2007 | Tomiyama | H04R 9/025<br>381/400 |
| 2009/0116670 | A1* | 5/2009 | Akino | H04R 9/048<br>381/176 |
| 2011/0261980 | A1* | 10/2011 | Akino | H04R 9/048<br>381/176 |
| 2017/0010310 | A1* | 1/2017 | Morel | G01R 1/04 |
| 2018/0077496 | A1* | 3/2018 | Maeda | H04R 9/025 |

* cited by examiner

SPEAKER DEVICE AND MICROPHONE DEVICE

RELATED APPLICATION

The present application claims priority to Japanese Patent Application Number 2016-177712, filed Sep. 12, 2016, the entirety of which is hereby incorporated by reference.

BACKGROUND

1. Field

The present disclosure relates to a speaker device and a microphone device including a vibration unit in which a ribbon-like diaphragm is disposed in a magnetic gap.

2. Description of the Related Art

Conventional examples of a vibration unit included in a speaker device, a microphone device, or the like, include the one proposed in JP 55-25231 A. In that vibration unit, a plurality of parallel conductors is formed on a diaphragm disposed in a magnetic gap, both end portions of the diaphragm are vibratably supported by a frame, and connection terminals formed on the frame are connected to the plurality of parallel conductors, whereby these components cooperate to function as a coil in the magnetic gap.

The diaphragm is a ribbon-like thin film member including a synthetic resin material such as nylon, and a plurality of parallel conductors including aluminum or the like is formed on the diaphragm. The frame includes an insulating material having high rigidity, and the diaphragm is disposed while being bent in a zigzag shape in a notch provided at the center of the frame. A pair of connection conductors and a plurality of terminals are provided in the frame so as to surround the notch. By superimposing the diaphragm and the frame such that conductor forming surfaces thereof face each other, the parallel conductors are each connected to an end portion of the connection conductor and the terminal to form a coil.

In a case where the vibration unit configured as described above is applied to a microphone device, when the diaphragm vibrates within the magnetic gap upon receiving sound pressure, a plurality of parallel conductors formed on the diaphragm crosses magnetic fluxes. As a result, an electromotive force is generated between the terminals of the frame by the electromagnetic induction action. In addition, in a case where the vibration unit having the above configuration is applied to a speaker device, when an audio signal is input between the terminals of the frame, currents in the same direction flow through the plurality of parallel conductors formed on the diaphragm. As a result, the diaphragm vibrates in a direction orthogonal to the plate surface thereof and the sound pressure is generated.

SUMMARY

In the conventional vibration unit disclosed in JP 55-25231 A, the plurality of parallel conductors and the connection conductors are disposed in the magnetic gap, and when currents in the same direction flow through the respective parallel conductors on the diaphragm, currents in the opposite direction flow through the pair of connection conductors formed on the frame with the diaphragm interposed therebetween. As a result, the frame on which the connection conductors are formed also vibrates in response to the audio signal. In this case, if the frequency is low, unnecessary sound is unlikely to occur, even when the diaphragm vibrates with a small amplitude. As the frequency becomes higher, however, there arises a problem in that large unnecessary sound (reverse phase sound) occurs, even with vibration of a small amplitude, leading to reduction of volume and deterioration of sound quality.

The present disclosure has been made in view of these deficiencies. A first object of the present disclosure is to provide a speaker device capable of improving sound quality by suppressing occurrence of unnecessary sound. A second object of the present disclosure is to provide a microphone device capable of suppressing detection of unnecessary sound.

In order to achieve the first object, a speaker device according to an embodiment of the present disclosure includes: a magnetic circuit having a magnetic gap; a ribbon-like diaphragm disposed in a magnetic field in the magnetic gap; a plurality of parallel conductors provided on the diaphragm, extending in a direction orthogonal to a direction of the magnetic field, and aligned along the direction of the magnetic field; and, a driving unit that supplies a driving current to the plurality of parallel conductors, wherein a connection conductor is provided that electrically connects a first end of one of the parallel conductors to a second end of another parallel conductor such that driving currents in the same direction flow through the plurality of parallel conductors, and that is disposed so as to bypass the magnetic gap.

In the speaker device according to an embodiment of the present disclosure, both end portions of the diaphragm are continuous via a pivoting board disposed so as to bypass the magnetic gap, and the connection conductor is provided on the pivoting board so as to spirally connect the plurality of parallel conductors.

In the speaker device configured as described above, the connection conductors, which are provided such that currents in the same direction flow through the plurality of parallel conductors on the diaphragm, are not disposed in the magnetic gap, and thus not influenced by the magnetic field in the magnetic gap. Therefore, the connection conductors and the pivoting board do not vibrate, making it possible to suppress the occurrence of unnecessary sound (reverse phase sound) and to improve sound quality.

In the speaker device having the above configuration, the plurality of parallel conductors may be provided only on one surface of the diaphragm, but if the plurality of parallel conductors is provided on each of the front and back surfaces of the diaphragm, a large number of parallel conductors can be provided on the diaphragm with a limited size and a driving force can be enhanced.

In this case, if a gap region existing between the plurality of parallel conductors provided on any one surface of the diaphragm overlaps, in a plane, the parallel conductor provided on the other surface of the diaphragm, the strength of the diaphragm reduced by the gap region is supplemented by the parallel conductor on the opposite surface. Therefore, the strength along the width direction of the diaphragm is made uniform, and the occurrence of unnecessary sound can be more effectively suppressed.

In the speaker device having the above configuration, when the connection conductors are provided on each of the front and back surfaces of the pivoting board and electrically connected via through holes, it is possible to easily supply currents in the same direction to the plurality of parallel conductors provided on the front and back surfaces of the diaphragm.

In the speaker device having the above configuration, if the connection conductor is at least partially formed wider than the parallel conductor, the impedance of the connection conductor can be lowered.

In the speaker device having the above configuration, if the connection conductor is at least partially formed thicker than the parallel conductor, the impedance of the connection conductor can be lowered.

In the speaker device having the above configuration, the diaphragm and the pivoting board may be connected in an annular shape in the same plane (two-dimensionally). However, if the pivoting board extends from one end portion of the diaphragm to the other end portion of the diaphragm through the bottom surface of the magnetic circuit, the diaphragm and the pivoting board are formed into a tubular body connected stereoscopically (three-dimensionally). By disposing this tubular body between the magnetic gap and the bottom surface of the magnetic circuit, it is possible to reduce the size of the speaker device.

In this case, if the pivoting board is at least partially formed wider than the diaphragm, not only can the connection conductors be routed easily, but also the width of the connection conductors can be widened to lower the impedance.

In the speaker device having the above configuration, when the diaphragm and the pivoting board include a resin film continuous in a band shape and the parallel conductor and the connection conductor include a metal pattern formed on the resin film, the plurality of parallel conductors and the connection conductors can be collectively formed on the resin film, which is preferable.

In order to achieve the second object, a microphone device according to an embodiment of the present disclosure includes: a magnetic circuit having a magnetic gap; a ribbon-like diaphragm disposed in a magnetic field in the magnetic gap; a plurality of parallel conductors provided on the diaphragm, extending in a direction orthogonal to a direction of the magnetic field, and aligned along the direction of the magnetic field; and, a detection unit that detects an electromotive force generated between the plurality of parallel conductors by vibration of the diaphragm, wherein a connection conductor is provided that electrically connects a first end of one of the parallel conductors to a second end of another parallel conductor such that detection currents in the same direction flow through the plurality of parallel conductors, and that is disposed so as to bypass the magnetic gap.

In the microphone device thus configured, when the diaphragm vibrates within the magnetic gap upon receiving sound pressure, electromotive forces in the same direction are generated in the plurality of parallel conductors formed on the diaphragm. Since the connection conductors that extract the electromotive forces are provided so as to bypass the magnetic gap, the connection conductors do not vibrate, and the recording quality can be improved by suppressing detection of unnecessary sound (reverse phase sound).

According to an embodiment of the present disclosure, it is possible to provide a speaker device and a microphone device capable of suppressing occurrence of unnecessary sound and improving sound quality.

BRIEF DESCRIPTION OF THE DRAWINGS

FIGS. 4A and 4B are views showing a main part of a diaphragm provided in the speaker device of FIG. 1, wherein FIG. 4A is a front view and FIG. 4B is a cross-sectional view;

DETAILED DESCRIPTION

Figure 1:
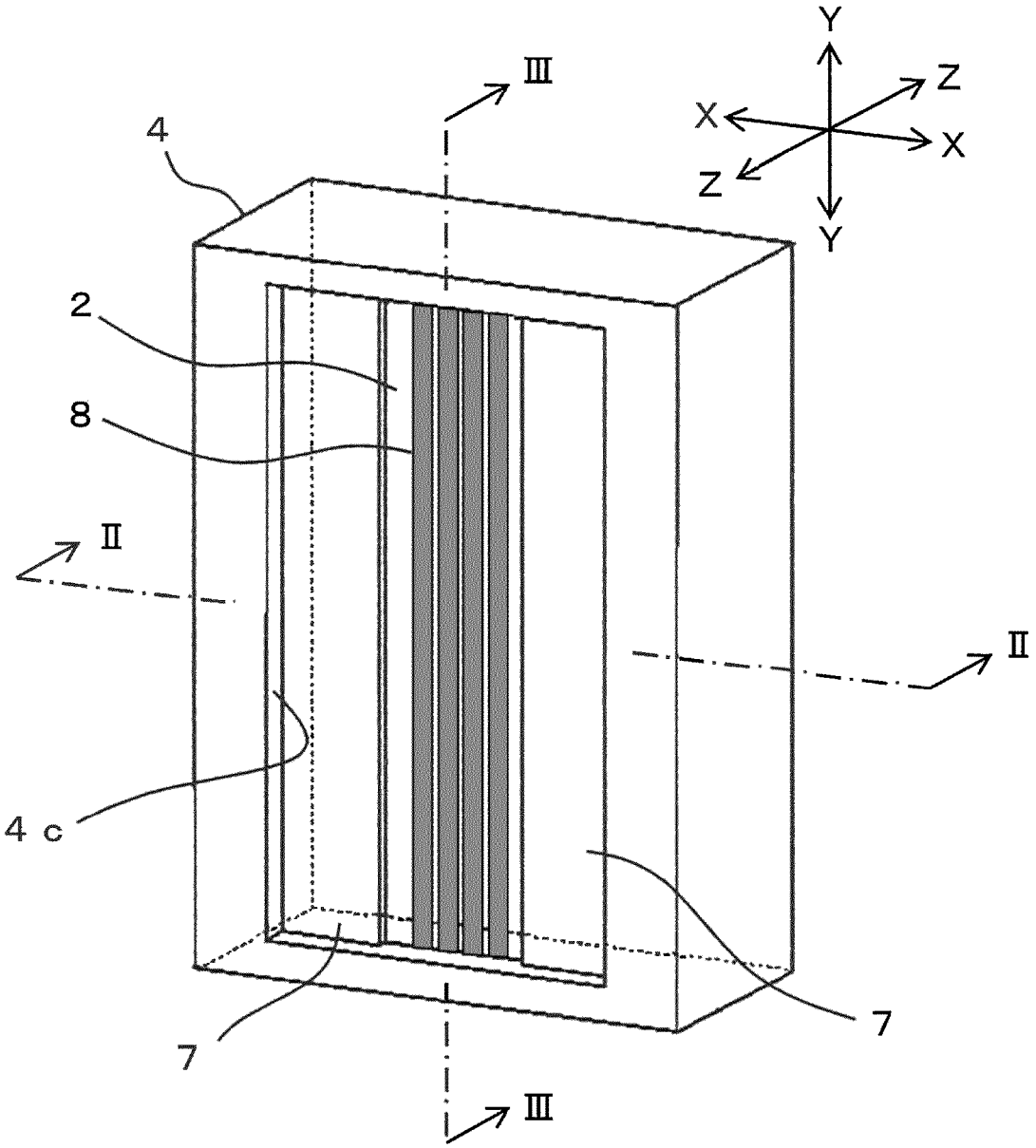
FIG. 1 is an external perspective view of a speaker device according to an embodiment of the present disclosure.
Figure 2:
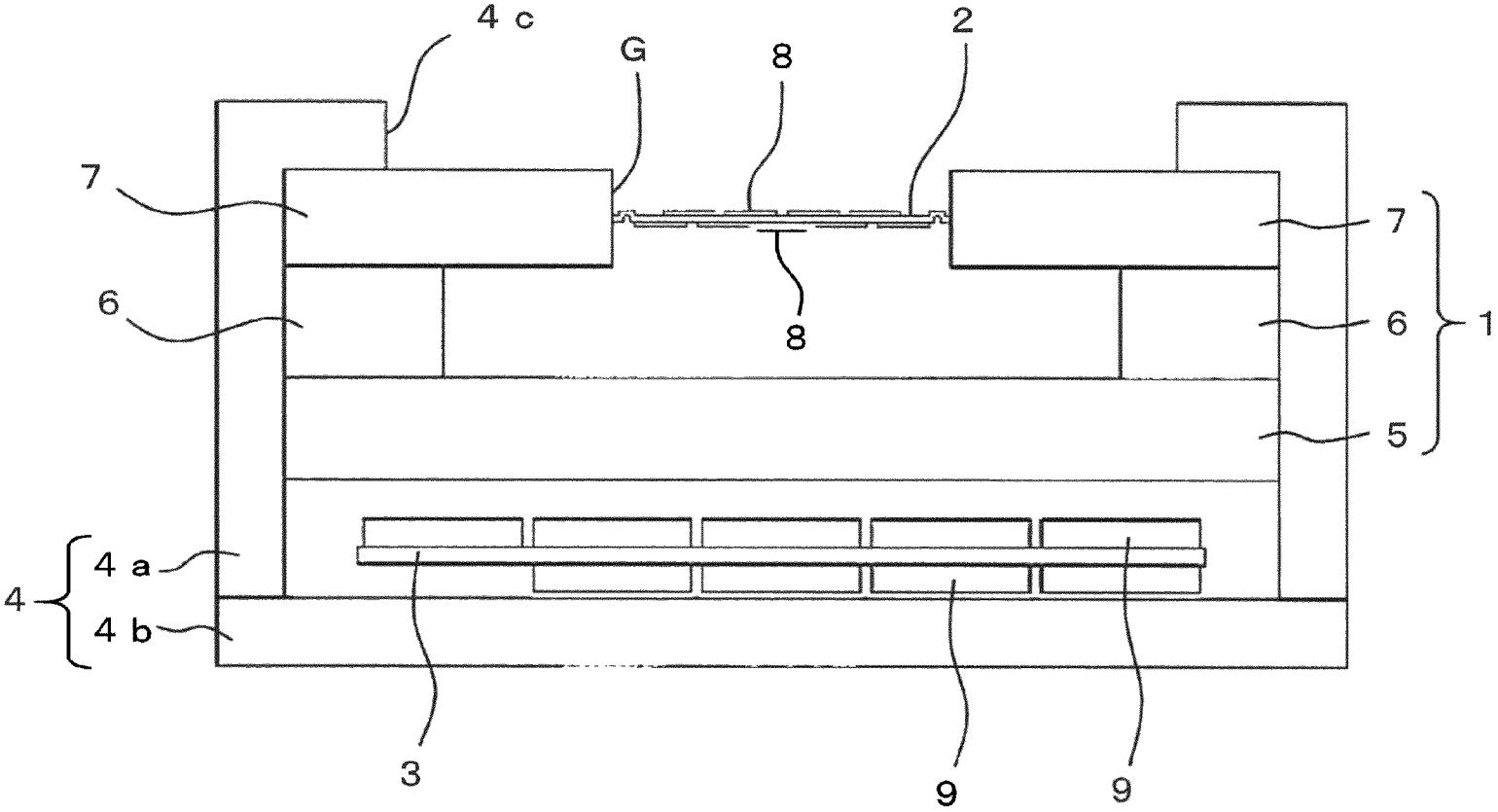
FIG. 2 is a cross-sectional view taken along line II-II of FIG. 1.
Figure 3:
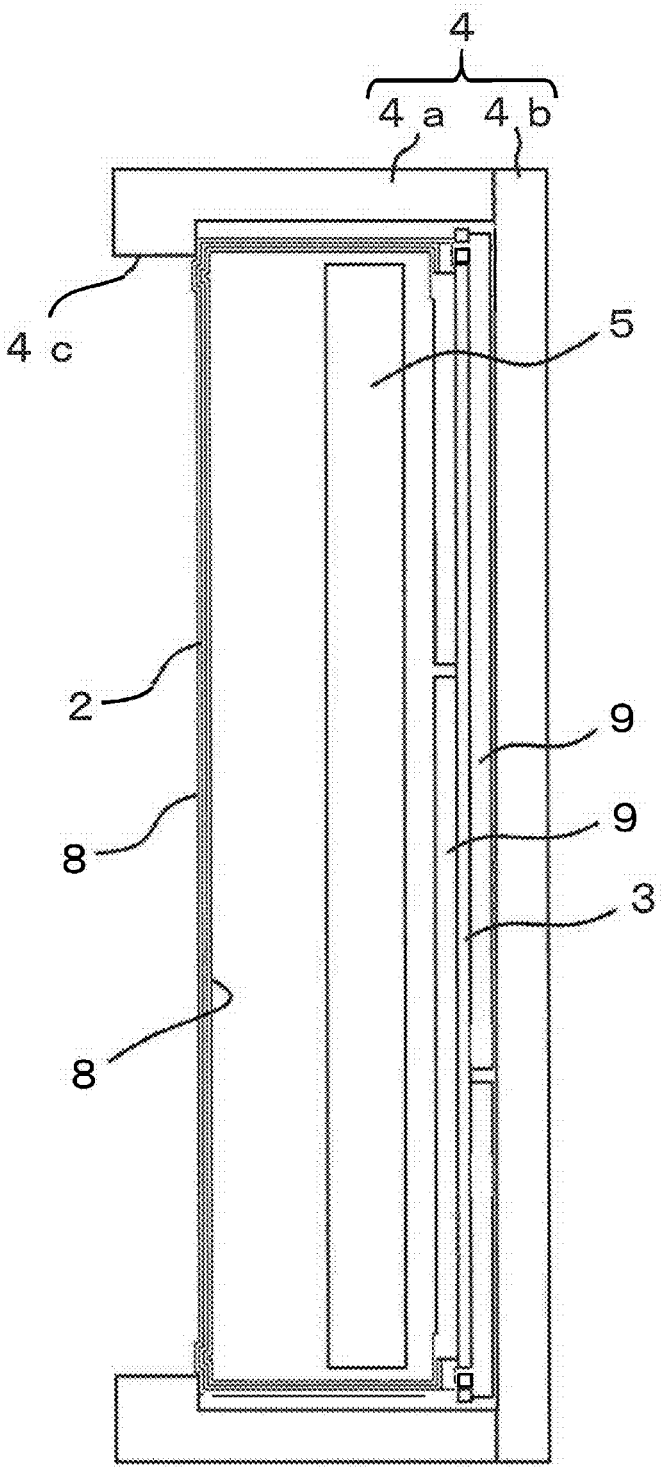
FIG. 3 is a cross-sectional view taken along line III-III of FIG. 1.

Hereinafter, an embodiment of the present disclosure will be described with reference to the drawings. As shown in FIGS. 1 to 3, a speaker device according to an embodiment of the present disclosure mainly includes a magnetic circuit 1 having a magnetic gap G, a ribbon-like diaphragm 2 disposed in the magnetic gap G, a pivoting board 3, and a frame 4. The pivoting board 3 is connected to both end portions in the longitudinal direction of the diaphragm 2 so as to bypass the magnetic gap G. The frame 4 supports the magnetic circuit 1, the diaphragm 2, and the pivoting board 3.

The magnetic circuit 1 includes a planar back plate 5, a pair of magnets 6 placed on the back plate 5, and a pair of top plates 7 laminated on the back plate 5 with the magnets 6 interposed therebetween. The pair of top plates 7 is disposed while facing each other along the X direction in FIG. 1, and the magnetic gap G is formed between the top plates 7.

The diaphragm 2 is a rectangular thin film member including a resin film of polyimide, for example. The diaphragm 2 is disposed in the magnetic gap G so as to extend along the XY plane of FIG. 1. A plurality of parallel conductors 8 is formed on each of the front and back surfaces of the diaphragm 2. The parallel conductors 8 extend along the longitudinal direction (Y direction in FIG. 1) of the diaphragm 2 and are aligned along the direction of the magnetic field. The parallel conductor 8 is a conductor pattern including a metal foil of aluminum, for example. In the present embodiment, four parallel conductors 8 are formed on the front surface of the diaphragm 2 and five parallel conductors 8 on the back surface thereof, i.e., nine parallel conductors 8 are formed in total.

Figure 4A:
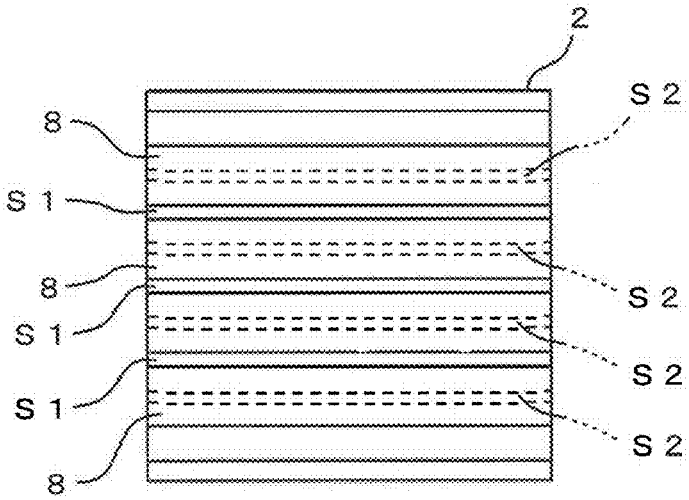
Figure 4B:
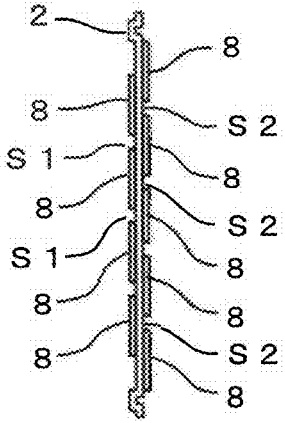

As shown in FIGS. 4A and 4B, the parallel conductors 8 are formed at positions shifted in the lateral direction (X direction in FIG. 1) between the front surface and the back surface of the diaphragm 2. The parallel conductors 8 formed on the front surface each overlap, in a plane, a gap region S2 existing between the parallel conductors 8 on the back surface. The parallel conductors 8 formed on the back surface each overlap, in a plane, a gap region S1 existing between the parallel conductors 8 on the front surface. In this way, the gap region S1 (or S2) existing between the parallel conductors 8 formed on one surface of the diaphragm 2 overlaps, in a plane, the parallel conductor 8 formed on the other surface of the diaphragm 2. Therefore, the strength of the diaphragm 2 reduced at the gap regions S1 and S2 is supplemented by the parallel conductors 8 existing on the opposite surface side of each gap region, and thus the diaphragm 2 has a uniform strength along the width direction.

The pivoting board 3 extends from one end portion of the diaphragm 2 to the other end portion of the diaphragm 2 via the bottom surface of the magnetic circuit 1 (the lower surface of the back plate 5). Connection conductors 9 are formed on both front and back surfaces of the pivoting board 3 and connected to the parallel conductors 8. The pivoting board 3 and the diaphragm 2 are integrated into a ring shape using a resin film of polyimide, for example. The parallel conductors 8 and the connection conductors 9 each including a metal foil of aluminum or the like are patterned on this resin film. As will be described in detail later, the plurality of parallel conductors 8 and the connection conductors 9 are spirally continuous, and one connection conductor 9 electrically connects one end of one parallel conductor 8 and the other end of another parallel conductor 8. Therefore, currents in the same direction flow through the plurality of parallel conductors 8.

The frame 4 has a housing structure obtained by combining an upper case 4*a* and a base plate 4*b*. The upper case 4*a* and the base plate 4*b* are integrated using fastening means such as screwing or snap coupling. The upper case 4*a* and the base plate 4*b* are molded articles formed of a synthetic resin material, and an opening 4*c* is provided in the upper surface of the upper case 4*a*. The magnetic circuit 1, the diaphragm 2, and the pivoting board 3 are housed and held inside the frame 4, so that the diaphragm 2 and the top plate 7 are exposed through the opening 4*c*.

Figure 5:
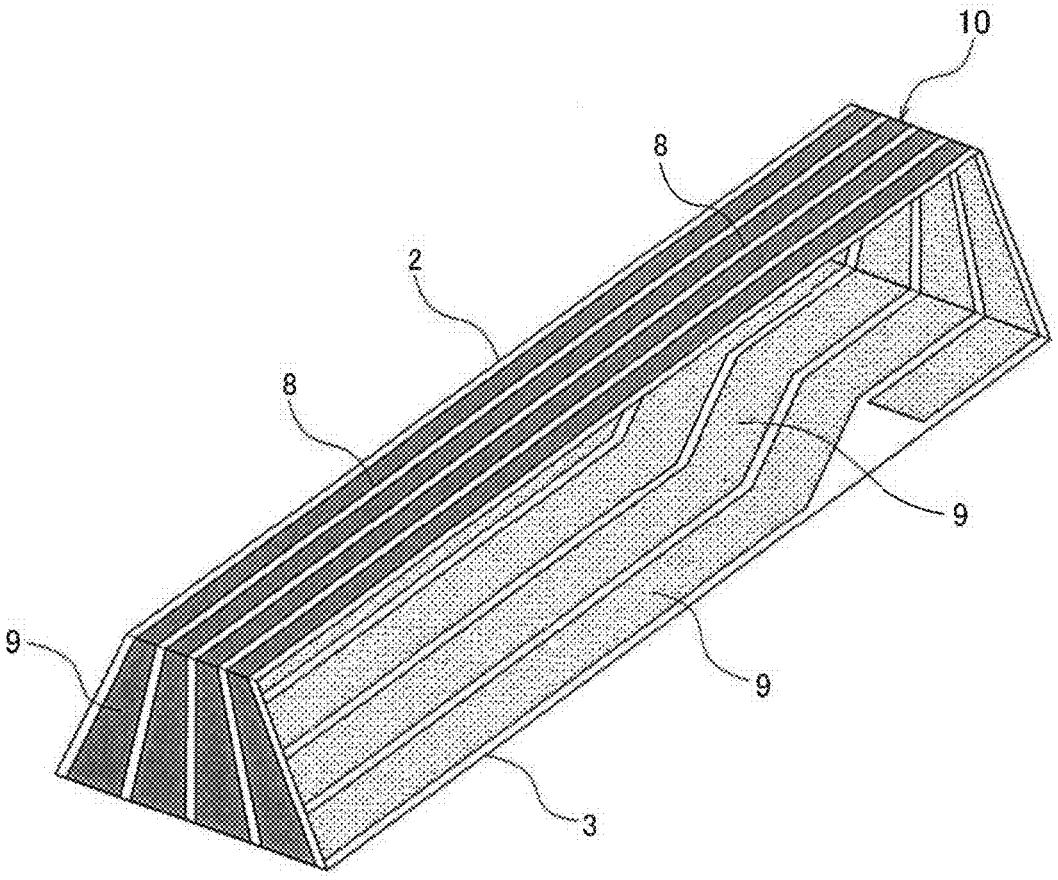
FIG. 5 is a perspective view of the diaphragm and a pivoting board provided in the speaker device of FIG. 1.
Figure 6A:
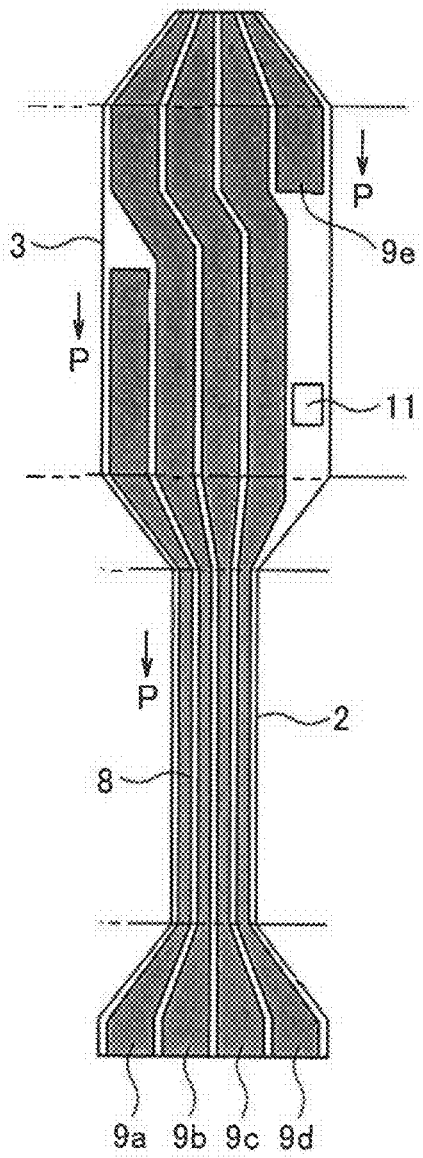
FIGS. 6A and 6B are exploded views of the diaphragm and the pivoting board of FIG. 5, as viewed from the front side and the back side respectively.
Figure 6B:
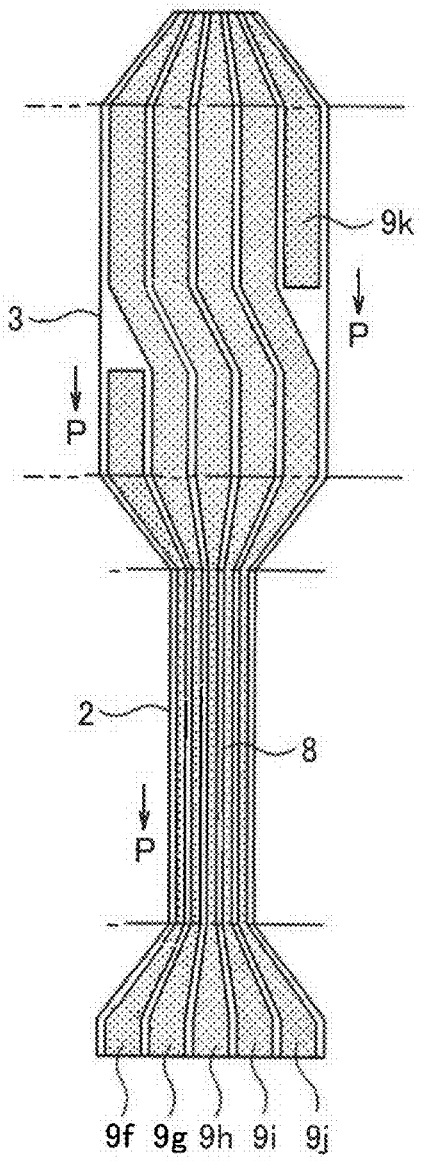

FIG. 5 is a perspective view showing the appearance of a ring-shaped board 10 in which the diaphragm 2 and the pivoting board 3 are integrated. FIGS. 6A and 6B are explanatory views showing the exploded ring-shaped board 10.

As shown in FIG. 5, the diaphragm 2 is formed on the upper surface of the ring-shaped board 10, and the pivoting board 3 is formed from both side surfaces to the bottom surface of the ring-shaped board 10. Although the diaphragm 2 and the bottom surface of the pivoting board 3 face each other in parallel at a predetermined interval, the width dimension of the bottom surface of the pivoting board 3 is formed to be considerably wider than the width dimension of the diaphragm 2. With this configuration, both side surfaces of the pivoting board 3 are trapezoidal. The parallel conductors 8 are formed on the diaphragm 2 as narrow fine patterns, while the connection conductors 9 are formed on the pivoting board 3 as wide patterns having a larger width dimension than the parallel conductors 8. The overall impedance is lowered with this configuration. Note that the overall impedance may be lowered by making the connection conductor 9 thicker than the parallel conductor 8.

As shown in FIG. 6A, the multiple parallel conductors 8 and connection conductors 9, and a terminal portion 11 are formed on the front surface of the ring-shaped board 10. As shown in FIG. 6B, the multiple parallel conductors 8 and connection conductors 9 are formed on the back surface of the ring-shaped board 10. For the sake of convenience, the connection conductors 9 formed on the front surface of the ring-shaped board 10 are numbered 9*a* to 9*e* in that order from the left, and the connection conductors 9 formed on the back surface of the ring-shaped board 10 are numbered 9*f* to 9*k* in that order from the left. In this case, the upper end portion of the connection conductor 9*b* on the front surface is electrically connected to the lower end portion of the connection conductor 9*k* on the back surface via a through hole, and the terminal portion 11 on the front surface is electrically connected to the upper end portion of the connection conductor 9*f* on the back surface via a through hole. As a result, an audio signal is input between the terminal portion 11 and the connection conductor 9*e*.

When the ring-shaped board 10 shown in FIGS. 6A and 6B is folded at a right angle at the positions indicated by the two-dot chain lines in FIGS. 6A and 6B and the upper and lower ends thereof are overlapped to form the ring shape shown in FIG. 5, the lower end of the connection conductor 9*a* is connected to the upper end of the connection conductor 9*b*, the lower end of the connection conductor 9*b* is connected to the upper end of the connection conductor 9*c*, the lower end of the connection conductor 9*c* is connected to the upper end of the connection conductor 9*d*, and the lower end of the connection conductor 9*d* is connected to the upper end of the connection conductor 9*e*. As a result, the four parallel conductors 8 formed on the front surface of the diaphragm 2 are connected spirally via the connection conductors 9*a* to 9*e*. On the back surface of the ring-shaped board 10, the lower end of the connection conductor 9*f* is connected to the upper end of the connection conductor 9*g*, the lower end of the connection conductor 9*g* is connected to the upper end of the connection conductor 9*h*, the lower end of the connection conductor 9*h* is connected to the upper end of the connection conductor 9*i*, the lower end of the connection conductor 9*i* is connected to the upper end of the connection conductor 9*j*, and the lower end of the connection conductor 9*j* is connected to the upper end of the connection conductor 9*k*. As a result, the five parallel conductors 8 formed on the back surface of the diaphragm 2 are connected spirally via the connection conductors 9*f* to 9*k*.

In this state, when a current in the direction of an arrow P, for example, flows through the connection conductor 9*f* on the back surface from the terminal portion 11, the current in the direction of the arrow P flows through the five parallel conductors 8 on the back surface of the diaphragm 2, the current in the direction of the arrow P flows through the connection conductor 9*a* on the front surface from the connection conductor 9*k*, and the current in the direction of the arrow P also flows through the four parallel conductors 8 on the front surface of the diaphragm 2. As a result, the currents in the same direction flow through a total of nine parallel conductors 8 on the front and back surfaces of the diaphragm 2.

Note that the ring-shaped board 10 shown in FIG. 5 may be incorporated into the frame 4. In the present embodiment, however, the bottom surface portion of the pivoting board 3 facing the diaphragm 2 is formed using a printed circuit board, and the connection conductors 9 on the ring-shaped board 10 are connected, through a connector or the like, to the connection conductors 9 including a copper foil pattern and provided on both front and back surfaces of the printed circuit board.

In the speaker device thus configured, when an audio signal is input between the terminal portion 11 exposed on the bottom surface of the pivoting board 3 and the lower end portion of the connection conductor 9*e*, currents in the same direction flow through the plurality of parallel conductors 8 formed on the diaphragm 2. As a result, the diaphragm 2 vibrates in a direction orthogonal to the plate surface thereof (Z direction in FIG. 1) to generate sound pressure, and this sound pressure is emitted to the outside from the opening 4*c* of the frame 4. At this time, the connection conductors 9 provided on the pivoting board 3 are not disposed in the magnetic gap G, and thus not influenced by the magnetic field in the magnetic gap G. Therefore, the pivoting board 3 and the connection conductors 9 do not vibrate, making it possible to suppress the occurrence of unnecessary sound (reverse phase sound) and to improve sound quality.

As described above, the speaker device according to the present embodiment adopts the following configuration as a driving unit that supplies driving currents in the same direction to the plurality of parallel conductors 8 on the diaphragm 2. That is, the connection conductors 9 are formed on the pivoting board 3 that is led out from both end portions of the diaphragm 2 and bypasses the magnetic gap G. Since the connection conductors 9 are not influenced by the magnetic field in the magnetic gap G, the pivoting board 3 and the connection conductors 9 do not vibrate, making it possible to suppress the occurrence of unnecessary sound (reverse phase sound) and to improve sound quality.

Furthermore, in the speaker device according to the present embodiment, the plurality of parallel conductors 8 is formed on each of the front and back surfaces of the diaphragm 2. Generally, therefore, the driving force can be significantly increased as compared with the ribbon-like diaphragm. In addition, the gap region S1 (or S2) existing between the parallel conductors 8 formed on one surface of the diaphragm 2 overlaps, in a plane, the parallel conductor 8 formed on the other surface of the diaphragm 2, and the connection conductors 9 including metal patterns are alternately disposed on the front and back surfaces of the diaphragm 2 including a resin film. Therefore, the strength of the diaphragm 2 reduced at the gap regions S1 and S2 is supplemented by the parallel conductors 8 existing on the opposite surface side of each gap region, and thus the diaphragm 2 can have a uniform strength along the width direction.

In the speaker device according to the present embodiment, the connection conductors 9 are formed on each of the front and back surfaces of the pivoting board 3, and these connection conductors 9 are electrically connected via the through holes. Therefore, it is possible to easily supply driving currents in the same direction to the plurality of parallel conductors 8 formed on the front and back surfaces of the diaphragm 2.

Furthermore, in the speaker device according to the present embodiment, the pivoting board 3 disposed while bypassing the magnetic gap G is set wider than the diaphragm 2, and the connection conductor 9 formed on the pivoting board 3 is formed wider than the parallel conductor 8 on the diaphragm 2. Therefore, the impedance of the connection conductor 9 can be lowered. In addition, since the bottom surface portion of the pivoting board 3 facing the diaphragm 2 is formed using the printed circuit board, it is possible to suppress the power loss by increasing the conductor width and thickness of the connection conductor 9 on the printed circuit board. However, it is also possible to form the diaphragm 2 and the pivoting board 3 from a single resin film, in which case it is preferable to attach a reinforcing plate or the like to the bottom surface portion of the pivoting board 3 facing the diaphragm 2.

In the speaker device according to the present embodiment, the pivoting board 3 extends from one end portion of the diaphragm 2 to the other end portion of the diaphragm 2 through the bottom surface of the magnetic circuit 1 (the lower surface of the back plate 5), and the diaphragm 2 and the pivoting board 3 are connected stereoscopically (three-dimensionally) to constitute the ring-shaped board 10. Therefore, it is possible to reduce the size of the speaker device by disposing the ring-shaped board 10 between the magnetic gap G and the bottom surface of the magnetic circuit 1. Alternatively, the diaphragm 2 and the pivoting board 3 may be connected in an annular shape in the XY plane (two-dimensionally) in FIG. 1.

The vibration unit having the above configuration used in the speaker device according to the present embodiment is also applicable to a microphone device. In that case, the microphone device should have the following configuration. That is, the microphone device includes a magnetic circuit having a magnetic gap, a ribbon-like diaphragm disposed in a magnetic field in the magnetic gap, a plurality of parallel conductors provided on the diaphragm and extending in a direction orthogonal to a direction of the magnetic field, and a detection unit that detects an electromotive force generated between both ends of the plurality of parallel conductors by vibration of the diaphragm. Both end portions of the diaphragm are continuous via a pivoting board disposed so as to bypass the magnetic gap, and connection conductors for spirally connecting the plurality of parallel conductors are provided on the pivoting board.

What is claimed is:

1. A speaker device comprising:

a magnetic circuit having a magnetic gap;

a ribbon-like diaphragm disposed in a magnetic field in the magnetic gap;

a plurality of parallel conductors provided on the diaphragm, extending in a direction orthogonal to a direction of the magnetic field, and aligned along the direction of the magnetic field; and a driving unit that supplies a driving current to the plurality of parallel conductors, wherein a connection conductor is provided that electrically connects one end of one of the parallel conductors to an opposite end of another parallel conductor such that driving currents in the same direction flow through the plurality of parallel conductors, and that is disposed so as to bypass the magnetic gap.

2. The speaker device according to claim 1, wherein both end portions of the diaphragm are continuous via a board disposed so as to bypass the magnetic gap, and the connection conductor is provided on the board so as to spirally connect the plurality of parallel conductors.

3. The speaker device according to claim 1, wherein the plurality of parallel conductors is provided on each of front and back surfaces of the diaphragm.

4. The speaker device according to claim 3, wherein a gap region existing between the plurality of parallel conductors provided on any one surface of the diaphragm overlaps, in a plane, the parallel conductor provided on the other surface of the diaphragm.

5. The speaker device according to claim 2, wherein the connection conductors are provided on both front and back surfaces of the board, and the connection conductors are electrically connected via through holes.

6. The speaker device according to claim 2, wherein the connection conductor is at least partially formed wider than the parallel conductor.

7. The speaker device according to claim 2, wherein the connection conductor is at least partially formed thicker than the parallel conductor.

8. The speaker device according to claim 2, wherein the board extends from one end portion of the diaphragm to an other end portion of the diaphragm through a bottom surface of the magnetic circuit.

9. The speaker device according to claim 8, wherein the board is at least partially formed wider than the diaphragm.

10. The speaker device according to claim 8, wherein the diaphragm and the board include a resin film continuous in a band shape, and the parallel conductor and the connection conductor include a metal pattern formed on the resin film.

11. A microphone device comprising:

a magnetic circuit having a magnetic gap;

a ribbon-like diaphragm disposed in a magnetic field in the magnetic gap;

a plurality of parallel conductors provided on the diaphragm, extending in a direction orthogonal to a direction of the magnetic field, and aligned along the direction of the magnetic field; and a detection unit that detects an electromotive force generated between the plurality of parallel conductors by vibration of the diaphragm, wherein a connection conductor is provided that electrically connects one end of one of the parallel conductors to an opposite end of another parallel conductor such that detection currents in the same direction flow through the plurality of parallel conductors, and that is disposed so as to bypass the magnetic gap.

* * * * *